US008745876B2

(12) United States Patent
Hage et al.

(10) Patent No.: US 8,745,876 B2
(45) Date of Patent: Jun. 10, 2014

(54) SAFETY RAZOR

(75) Inventors: Preston Hage, Orlando, FL (US); Matthew G. Taylor, Longwood, FL (US)

(73) Assignee: Preston Hage, LLC, Orlando, FL (US)

( * ) Notice: Subject to any disclaimer, the term of this patent is extended or adjusted under 35 U.S.C. 154(b) by 432 days.

(21) Appl. No.: 13/010,945

(22) Filed: Jan. 21, 2011

(65) Prior Publication Data

US 2011/0173821 A1 Jul. 21, 2011

Related U.S. Application Data

(60) Provisional application No. 61/297,055, filed on Jan. 21, 2010.

(51) Int. Cl.

| | |
|---|---|
| ***B26B 19/00*** | (2006.01) |
| ***B26B 21/00*** | (2006.01) |
| ***B26B 21/52*** | (2006.01) |

(52) U.S. Cl.

USPC ..... 30/34.1; 30/50; 30/527; 30/528

(58) Field of Classification Search

USPC ..... 30/32, 34.1, 40, 47–51, 53, 57, 58, 64, 30/68–73, 75, 526–528; D28/45–48

See application file for complete search history.

(56) References Cited

U.S. PATENT DOCUMENTS

| | | | | | |
|---|---|---|---|---|---|
| 843,059 | A | * | 2/1907 | Arnold | 30/53 |
| 913,186 | A | * | 2/1909 | Arnold | 30/47 |
| 978,705 | A | * | 12/1910 | Dannacher | 30/51 |
| 1,059,774 | A | * | 4/1913 | Sharpneck | 30/53 |
| 1,089,727 | A | * | 3/1914 | Sharpnack | 30/53 |
| 1,092,367 | A | * | 4/1914 | Knapp | 30/50 |
| 1,226,614 | A | | 5/1917 | Hiskey | |
| 1,801,889 | A | | 4/1931 | Ventimiglia | |
| 2,127,881 | A | * | 8/1938 | Morris | 30/34.1 |
| 2,243,441 | A | * | 5/1941 | Russell | 30/34.1 |
| 2,269,875 | A | * | 1/1942 | Huntington | 30/34.1 |

(Continued)

FOREIGN PATENT DOCUMENTS

| | | | |
|---|---|---|---|
| JP | 04347191 | A * | 12/1992 |
| JP | 05-123460 | | 5/1993 |
| WO | 2008-077875 | | 7/2008 |
| WO | WO 2011091226 | A3 * | 7/2011 |

OTHER PUBLICATIONS

PCT International Searching Authority, International Search Report and Written Opinion dated Nov. 3, 2011, entire document.

*Primary Examiner* — Jason Daniel Prone

(74) *Attorney, Agent, or Firm* — Matthew G. McKinney

(57) ABSTRACT

A safety razor includes a handle assembly elongated along a longitudinal axis, a blade head assembly pivotably connected to the handle assembly and having a first blade set thereon, the first blade set extending generally in parallel with the longitudinal axis. The blade head assembly can be releasably connected to the handle assembly to facilitate replacement. The blade head assembly can include a second blade set, the second blade set extending generally in parallel with the longitudinal axis, the first and second blade sets arranged facing away from each other such that the shaving direction of the blade head assembly can be altered by rotating the safety razor about the longitudinal axis. The safety razor can further include a biasing element for resisting pivotal motion of the blade assembly about the longitudinal axis and a control mechanism operable to selectively limit the pivotal motion of the blade head assembly.

9 Claims, 3 Drawing Sheets

(56) References Cited

U.S. PATENT DOCUMENTS

| | | | | | |
|---|---|---|---|---|---|
| 2,352,813 | A | * | 7/1944 | Testi | 30/64 |
| 2,380,461 | A | * | 7/1945 | Pedersen et al. | 30/43.4 |
| 2,501,987 | A | | 3/1950 | Brown | |
| 2,565,062 | A | * | 8/1951 | Blanchard | 30/32 |
| 2,574,472 | A | * | 11/1951 | Galvao | 30/43.6 |
| 2,704,886 | A | * | 3/1955 | Finelli | 30/54 |
| D190,325 | S | * | 5/1961 | Pepin | D28/46 |
| 3,137,940 | A | * | 6/1964 | Curci | 30/40 |
| 3,430,341 | A | * | 3/1969 | Choate | 30/40 |
| 3,619,900 | A | * | 11/1971 | Matsuura | 30/40 |
| 3,722,091 | A | * | 3/1973 | Gagnon | 30/40 |
| 3,802,072 | A | | 4/1974 | Wintercorn | |
| 4,275,498 | A | * | 6/1981 | Ciaffone | 30/47 |
| 4,344,226 | A | | 8/1982 | Blake, III | |
| 4,430,794 | A | | 2/1984 | Miller | |
| 4,649,642 | A | * | 3/1987 | Nagasaki et al. | 30/34.1 |
| 4,884,338 | A | | 12/1989 | Stewart | |
| 5,343,622 | A | * | 9/1994 | Andrews | 30/50 |
| 5,522,137 | A | * | 6/1996 | Andrews | 30/50 |
| D388,540 | S | * | 12/1997 | Ramar | D28/45 |
| 5,934,291 | A | | 8/1999 | Andrews | |
| 5,979,056 | A | * | 11/1999 | Andrews | 30/49 |
| 6,055,731 | A | | 5/2000 | Zucker | |
| 6,082,007 | A | * | 7/2000 | Andrews | 30/50 |
| 6,141,875 | A | | 11/2000 | Andrews | |
| 6,161,287 | A | * | 12/2000 | Swanson et al. | 30/50 |
| 6,161,288 | A | * | 12/2000 | Andrews | 30/50 |
| 6,164,290 | A | * | 12/2000 | Andrews | 30/32 |
| 6,397,473 | B1 | * | 6/2002 | Clark | 30/50 |
| 6,434,828 | B1 | * | 8/2002 | Andrews | 30/50 |
| 6,442,840 | B2 | | 9/2002 | Zucker | |
| 6,493,950 | B1 | | 12/2002 | Kludjian et al. | |
| 6,505,403 | B1 | | 1/2003 | Andrews | |
| 6,550,148 | B2 | * | 4/2003 | Cecil | 30/526 |
| D482,492 | S | | 11/2003 | Cheung | |
| 6,823,594 | B2 | | 11/2004 | Kludjian et al. | |
| 6,877,227 | B2 | * | 4/2005 | Santhagens Van Eibergen et al. | 30/50 |
| 7,721,451 | B2 | * | 5/2010 | Psimadas et al. | 30/34.1 |
| 2004/0123467 | A1 | * | 7/2004 | Policappelli | 30/50 |
| 2004/0128835 | A1 | * | 7/2004 | Coffin et al. | 30/50 |
| 2008/0216329 | A1 | * | 9/2008 | Leventhal | 30/527 |
| 2009/0013534 | A1 | * | 1/2009 | Mallaridas | 30/50 |
| 2010/0064520 | A1 | * | 3/2010 | Park et al. | 30/34.1 |

* cited by examiner

SAFETY RAZOR

CROSS-REFERENCE TO RELATED APPLICATION

This application claims the benefit of U.S. Provisional Application Ser. No. 61/297,055, filed on Jan. 21, 2010, the contents of which are herein incorporated by reference in their entirety.

FIELD OF THE INVENTION

The present invention relates to razors, and more particularly, to safety razors with replaceable blade head assemblies.

BACKGROUND OF THE INVENTION

Numerous developments and improvements have been made to safety razors in the past several years. However, the general paradigm of the safety razor remains that of a blade head that is oriented perpendicularly to the blade handle, in contradistinction with traditional straight razors, in which the blade extends generally in parallel with the handle. Many shavers prefer the feel and motion offered by a straight razor, but may use a typically safety razor, instead, for fear of serious lacerations or other injury.

SUMMARY OF THE INVENTION

In view of the foregoing, it is an object of the present invention to provide an improved safety razor. In particular, it is an object of the present invention to provide a safety razor in which the blades are arranged substantially in parallel with a longitudinal axis of the handle.

According to an embodiment of the present invention, a safety razor includes a handle assembly elongated along a longitudinal axis, a blade head assembly pivotably connected to the handle assembly and having a first blade set thereon, the first blade set extending generally in parallel with the longitudinal axis. According to an aspect of the present invention, the blade head assembly is releasably connected to the handle assembly to facilitate replacement.

According to another aspect of the present invention, the blade head assembly includes a second blade set, the second blade set extending generally in parallel with the longitudinal axis, the first and second blade sets arranged facing away from each other such that the shaving direction of the blade head assembly can be altered by rotating the safety razor about the longitudinal axis.

According to further aspects of the present invention, the safety razor also includes a biasing element for resisting pivotal motion of the blade assembly relative to the handle assembly about the longitudinal axis and a control mechanism operable to selectively limit the pivotal motion of the blade head assembly relative to the handle assembly.

These and other objects, aspects and advantages of the present invention will be better appreciated in view of the drawings and following detailed description of a preferred embodiment.

DETAILED DESCRIPTION OF A PREFERRED EMBODIMENT

Figure 1:
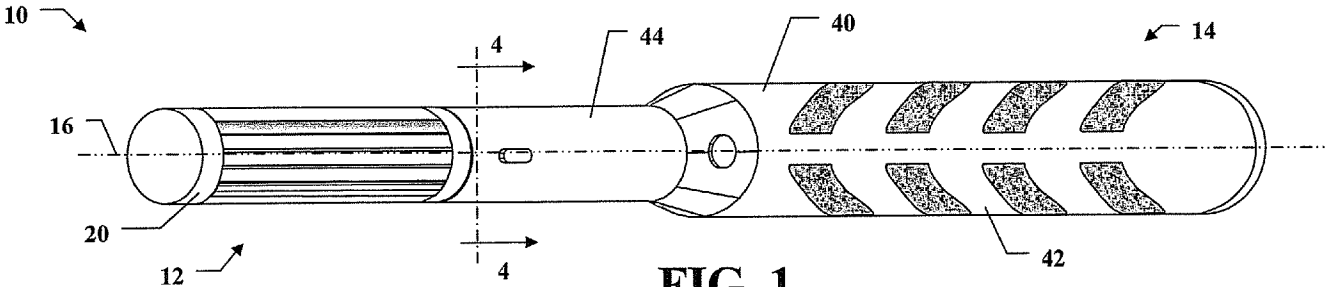
FIG. 1 is a front, left perspective view of a safety razor, including a blade head assembly and a handle assembly, according to an embodiment of the present invention.
Figure 2:
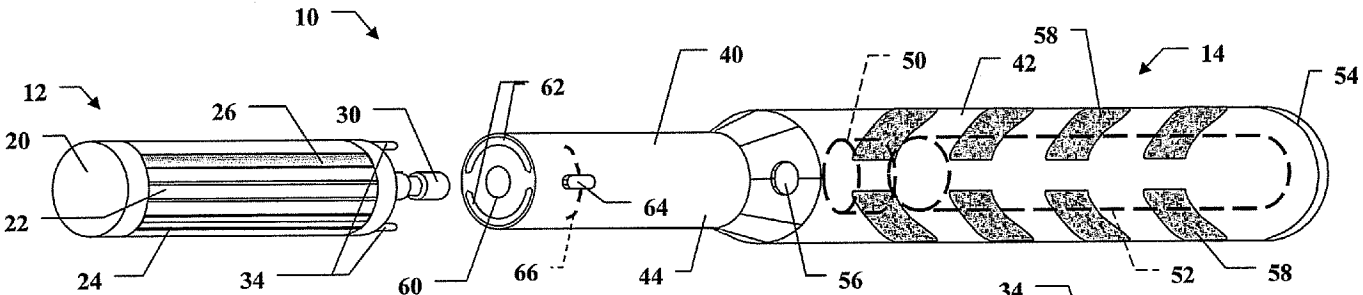
FIG. 2 is a partially-exploded front, left perspective view of the safety razor of FIG. 1.

Referring to FIGS. 1 and 2, according to an embodiment of the present invention, a safety razor 10 includes a blade head assembly 12 and a handle assembly 14. The blade head assembly 12 is releasably secured to the handle assembly 14 and pivotable relative thereto about a longitudinal axis 16 of the safety razor 10.

Figure 3:
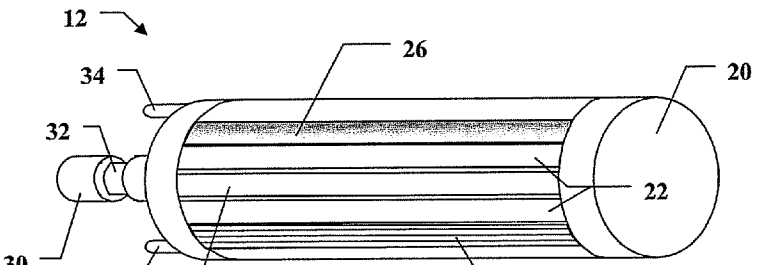
FIG. 3 is a right, front perspective view of the blade head assembly of FIG. 1.

Referring to FIGS. 2 and 3, the blade head assembly 12 includes a generally cylindrical head body 20 with substantially mirror-image blade sets 22, tactile strips 24 and applicant strips 26. As a result, the safety razor 10 is readily usable with both right and left hands, and to shave both with and against the grain. The head body 20 is preferably hollow to facilitate rinsing of the blade sets 22.

The blade sets 22 are arranged generally parallel and angled to cut using a downward motion, relative to the orientations of FIGS. 2 and 3. Each blade of a set 22 is preferably resiliently suspended within the head body 20 to allow for some flexing and movement of the blade relative to the head body 20 during shaving. At least one blade, and preferably multiple blades, are used in each blade set 22.

Each tactile strip 24 preferably includes a plurality of ridges and is formed from a rubberized or elastomeric material. The strips 24 are arranged below their respective blade sets 22 to lift hairs prior to cutting.

Each applicant strip 26 includes one or more consumable compounds, for instance skin moisturizers and/or lubricants. The strips 26 are arranged above their respective blade sets 22, such that the compounds are applied directly after hairs are cut. Additionally, the applicant strips 26 can include an indicator mechanism, such as a color layer that will be depleted with use, to indicate when replacement of the blade head assembly 12 should be performed.

The blade head assembly 12 further includes an attachment post 30, with an annular groove 32 formed therein, as well as biasing posts 34. The attachment post 30 extends substantially coaxially with the longitudinal axis 16, and is releasably, pivotably secured within the handle assembly 14 during use. The biasing posts 34 cooperate with the handle assembly 14 during shaving, as will be described in greater detail below.

Figure 4:
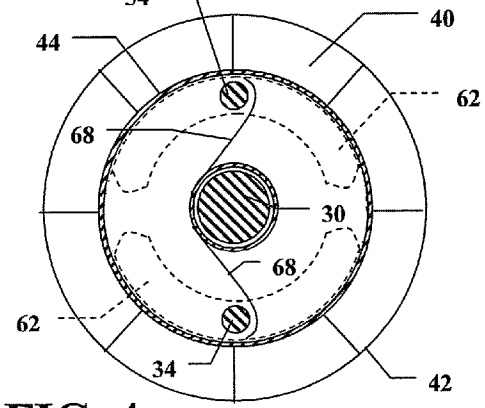
FIG. 4 is a sectional view taken along line 4-4 of FIG. 1.

Referring to FIGS. 2 and 4, the handle assembly 14 includes a grip section 42 and a blade head attachment section 44. Preferably, the blade head attachment section 44 is substantially equal in diameter to the blade head assembly 12 and the grip section 42 has an increased diameter relative to the blade head attachment section 44.

The grip section 42 can include a vibration device 50, such as an unbalanced motor, and battery 52, for generating a vibratory effect to enhance shaving. A removable end cap 54 allows for installation and replacement of the battery 52. A power button 56 allows for control of the vibratory effect. For easier gripping, textured surfaces 58 can also be incorporated into the grip section 42.

The blade attachment section 44 includes a central hole 60 and radial slots 62 defined therein. The central hole 60 and radial slots 62 are dimensioned to accommodate, respectively, the attachment post 30 and biasing posts 34 of the blade head assembly 12 therein.

A release button 64 communicates with arms 66 or other structure within the attachment section 44 to selectively disengage such structure from the annular groove 32, allowing removal of the blade head assembly 12.

Within the attachment section 44, biasing elements 68 engage the biasing posts 34, such that pivotal motion induced by shaving with either side of the blade head assembly 12 will be resisted by a respective one of the biasing elements 68. Also, the blade head assembly 12 will automatically return to its neutral position (as in FIG. 4) after shaving. Alternately, the attachment section 44 can be arranged such that the blade assembly 12 is blocked from pivotal motion when shaving with one side and permits pivotal motion, resisted by a biasing element, when shaving with the other side.

It will be appreciated that different interfaces could be used to allow pivotal motion between the blade head assembly 12 and the handle assembly 14, as well as rigid and/or integral connections. Additionally, components of the interface could be interchanged between the head and handle assemblies 12, 14. For example, the attachment post 30 could extend from the handle assembly 14.

During operation, a user loads a new blade head assembly 12 onto the handle assembly 14 by inserting the attachment post 30 into the central hole 60. The arms 66 are automatically biased into engagement with the groove 32 and retain the post 30 in the central hole 60. If vibratory motion is desired, the user will also ensure a battery 52 is in place.

The user will prepare the area to be shaved with shaving cream, lotion or the like, as with conventional razors. To start vibratory motion, the user will depress the power button 56. The user then begins shaving by moving the razor 10 over the area to be shaved with one side of the blade head assembly 12 toward the skin. A change in direction, for instance, shaving with and then against the grain of hair, can be accomplished by simply rotating the razor 10 180 degrees about the axis 16 and using the other side of the blade head assembly.

When finished shaving, the power button 56 is depressed again to stop the vibratory motion. If necessary, the blade head assembly 12 can be removed by depressing the release button 64, then disposed of and replaced.

Figure 5:
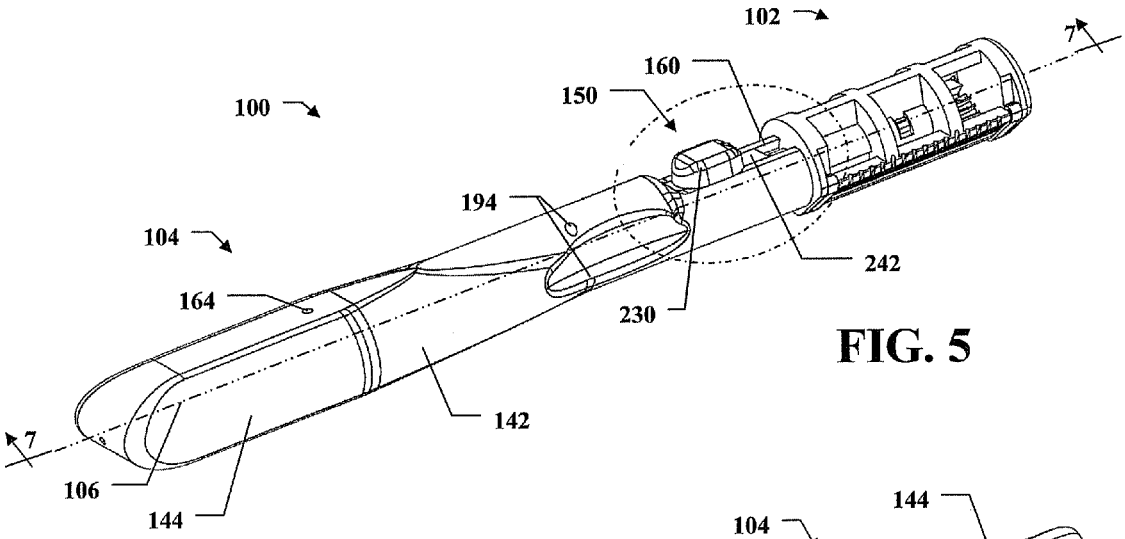
FIG. 5 is a perspective view of a safety razor, including a blade head assembly and a handle assembly, according to another embodiment of the present invention.
Figure 6:
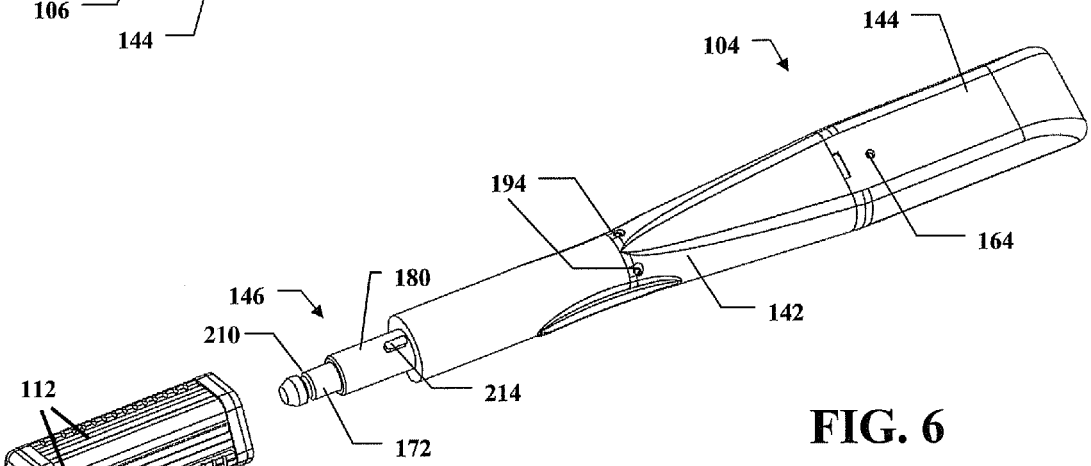
FIG. 6 is a perspective view of the safety razor of FIG. 5, with the blade head assembly detached.
Figure 7:
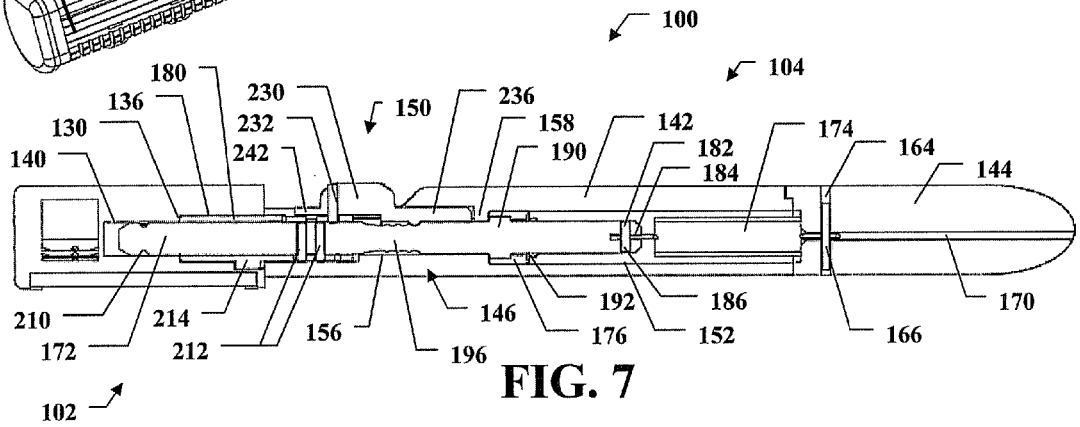
FIG. 7 is a sectional view taken along line 7-7 of FIG. 5.

According to another embodiment of the present invention, referring to FIGS. 5-7, a safety razor 100 includes a blade head assembly 102 and a handle assembly 104. The blade head assembly 102 is releasably secured to the handle assembly 104 and pivotable relative thereto about a longitudinal axis 106 of the safety razor 100.

Figure 8:
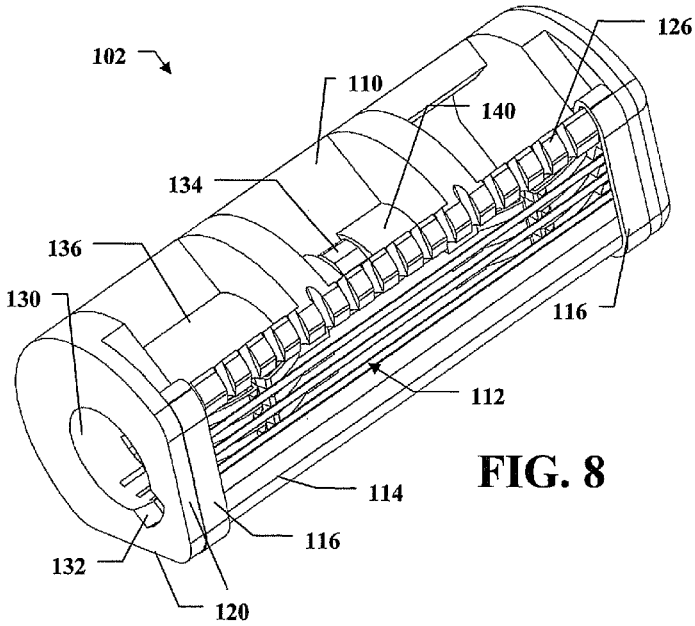
FIG. 8 is perspective view of the blade head assembly of FIG. 5.
Figure 9:
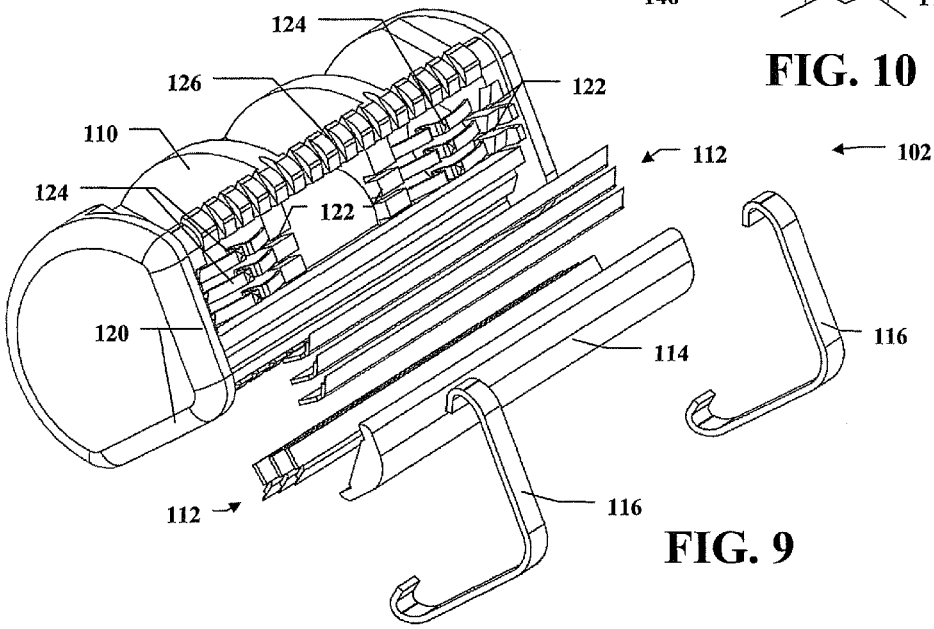
FIG. 9 is an exploded perspective view of the blade head assembly of FIG. 5.

Referring to FIGS. 8 and 9, the blade head assembly includes a generally cylindrical head body 110, a pair of blade sets 112, an applicant strip 114 and retention clips 116. The blade sets 112 are arranged facing away from each other on adjacent angled sections 120 of the body 110, with the applicant strip 114 extending between the blade sets 112 along an apex of the angled sections 120. The retention clips 116 snap onto the body 110 and hold the blade sets 112 and the applicant strip 114 thereto. As a result, the safety razor is readily usable with both right and left hands, and to shave both with and against the grain.

The head body 110 defines a plurality of blade mounting slots 122 therein inwardly of the angled sections 120 to properly mount and space the blade sets 112. Blade biasing strips 124 are formed integrally with the head body 110 and extend longitudinally behind the blade sets 122 to allow for flexing and movement of the blade sets 112 during shaving. Each of the biasing strips 124 has a generally bow-shaped profile, with a discrete contact point for engaging its respective blade formed centrally thereon. Adjacent to each contact point toward the center of its respective blade, a generally U-shaped section extends away from the blade to enhance flexing response of the strip 112.

Crenellated ridges 126 are formed adjacent to the blade sets along opposite edges of the angled sections 120 to serve as tactile strips. The crenellated ridges 126 facilitate lifting of hair prior to shaving. The crenellated ridges 126 can be formed integrally with the head body 110, or alternately attached thereto and formed from a rubber or other material having a higher coefficient of friction than the head body to further facilitating lifting of hairs.

A head channel 130 is defined centrally within the head body 110 to facilitate releasable connection with the handle assembly 104, as will be described in greater detail below. To further this end, a keyway 132 is defined extending into the head channel 130, and the body 110 further includes a resilient tab 134 extending into the head channel 130. The head channel 130 includes a first, wider diameter section 136, from which the keyway 132 extends, and a second, reduced diameter section 140, into which the resilient tab 134 extends. Clearances formed in the head body 110 around the head channel 130 facilitate rinsing of the blade sets 112.

The blade sets 112 each include at least one blade, and preferably a plurality of blades. The cutting edge of each blade in the sets 112 is angled away from the applicant strip 114 and toward its respective crenellated ridge 126.

The applicant strip 114 includes one or more consumable compounds, for instance skin moisturizers and/or lubricants. The applicant strip 114 can be formed as a reservoir holding a flowable compound which exits the reservoir through a surface membrane due to expansion of the compound in the presence of water. Alternately, the applicant strip can be formed as a solid strip that, in contact with moisture, forms a flowable compound. An indicator mechanism can be incorporated into the applicant strip 114 to indicate when blade head assembly 102 replacement is recommended. Rather than a single, solid strip 114 traversing the apex of the angled sections 120, dual strips could be used on either edge of the apex.

Referring again to FIGS. 5-7, the handle assembly 104 includes a handle body 142, a heel 144, a shaft assembly 146 and a control switch assembly 150. Preferably, the handle body 142 is dimensioned to be comfortably accommodated in either hand of a user during shaving.

The handle body 142 includes a handle channel 152 opening toward the heel 144 and a second section 156 opening toward the blade head assembly 102 with a constriction 158 therebetween. A slot 160 is defined through the handle body 142 extend rearwards from the opening of the section 156 in which the control switch assembly 150 is slidably arranged.

The heel 144 is secured to a first end of the handle body 142. A pin bore 164 extends through the heel 144 generally transverse to the longitudinal axis. A pin 166 inserted through the bore 164 anchors the shaft assembly 146 to the heel 144. An access channel 170 extends longitudinally through the heel 144, for use during initial assembly of the handle assembly 104, as will be described in greater detail below.

The shaft assembly 146 extends through the handle channel 152, extending out of the opening of the second section 156 thereof. The shaft assembly 146 includes a central shaft 172, a biasing element 174, a shaft bearing 176, and a shaft collar 180. A first end of the shaft assembly 146 is anchored in the heel 144, with the shaft assembly being pivotable within the handle channel 152. In conjunction with the control switch the shaft assembly 146 releasably mounts the blade head assembly 102 to the handle assembly 104 and allows pivoting of the blade head assembly 102 relative thereto.

The central shaft 172 includes a biasing element pin bore 182 and an intersecting biasing element slot 184 at a first end thereof. The biasing element 174 enters the central shaft 172 via the slot 184 and is pinned in place by a pin 186 inserted through the bore 182.

The central shaft 172 also includes an increased diameter central portion 190 that abuts the constriction 158 of the handle channel 152 and, adjacent the constriction 158, is surrounded by the shaft bearing 176. The shaft bearing 176 is longitudinally restrained by pins 192 extending through bores 194 the handle body 142 and through the handle channel 152. The shaft bearing 176 and constriction 158 cooperate to fix the longitudinal and axial position of the central shaft 172 within the handle channel 152 while allowing the central shaft to rotate relative thereto.

The central shaft 172 also has a control switch engagement section 196, with control switch position grooves 200-206 (see FIG. 10) defined therein, which correspond to functional positions of the control switch assembly 150, as will be described in greater detail below.

Proximate a second end thereof, a head assembly engagement annular groove 210 is defined the central shaft 172. The groove 210 is dimensioned for releasable engagement with the resilient tab 134 of the blade head assembly 102 to releasable secure the blade head assembly 102 about the end of the central shaft 172.

The biasing element 174 is preferably a coil spring or other biasing element capable of bi-directionally resisting pivoting of the central shaft 172, such that when external forces are removed, the central shaft 172 will return to a generally consistent neutral position (which is the position depicted in the FIGS. 5-7 and 10). Advantageously, the biasing element 174 is longitudinally pre-tensioned within the shaft channel 152 to enhance the spring response during use of the razor 100. The biasing element 174 can then also help securely mate the heel 144 and handle body 142.

The shaft collar 180 extends around the second end of the central shaft 172 inwardly of the annular groove 210. The shaft collar 180 is pinned to the central shaft 172 by pins 212 extending through respective aligned pin bores therein. As a result, the central shaft 172 and the shaft collar 180 will rotate together as a unit.

The shaft collar 180 includes a key 214 extending outwardly therefrom dimensioned for close engagement with the keyway 132 of the blade head assembly 102. This engagement ensures proper alignment of the blade head assembly 102 relative to the handle assembly 104, and also causes the blade head assembly 102 to rotate as a unit with the shaft collar 180 and the central shaft 172.

Figure 10:
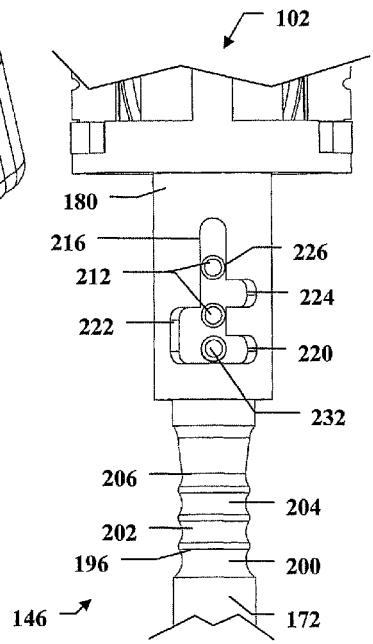
FIG. 10 is a detail view of area 10 of FIG. 5, with components removed to show internal details.

Referring also to FIG. 10, a control passageway 216 is defined in the shaft collar 180 underlying the control switch assembly 150. The control passageway 216 includes control sections 220-226, which correspond with control switch position grooves 200-206 and functional positions of the control switch assembly 150, as will be described in greater detail below.

The control switch assembly 150 includes a control switch body 230 and a control pin 232. The control switch assembly 150 is slidably arranged within the slot 160, extending into the handle channel 152, and is operable to control the pivotal motion of the blade head and shaft assemblies 102, 146 and to eject the blade head assembly 102 from the handle assembly 104.

The control switch body 230 includes an operator 234, dimensioned for easy manipulation by a user. A retention arm 236 extends into the handle channel 152. A protrusion 240 extends from a lower surface of the retention arm and is dimensioned for releasable engagement by the control switch position grooves 200-206 on the central shaft 172. An ejector arm 242 extends toward the blade head assembly 102.

The components of the safety razor 100 are preferably fabricated from metal and/or plastics, as appropriate. For example, the body 110 of the blade head assembly 102 can be an integrally molded piece, with the blade sets 112 inserted therein and retained by the retention clips. The blade sets 112 are preferably a high-grade stainless steel or other corrosion-resistant material capable of retaining a razor edge. The applicant strip 114 can be composed of substances as described above.

In assembling the handle assembly 104, the central shaft 172 and shaft bearing 176 are inserted into handle channel 152 from the first end, with the biasing element 174 affixed to the end of the central shaft. The central shaft 172 is inserted until its central portion 190 abuts the constriction 158. The pins 192 are inserted to retain the shaft bearing 176 in place.

A string or other line is attached to the free end of the biasing element 174 and threaded through the access channel 170 of the heel 144. The heel 144 is then attached to the handle body 142. Using the string, the biasing element 174 is pre-tensioned and then pinned in place with the pin 166.

The shaft collar 180 is slid over the second end of the central shaft 172 and pinned in place with pins 212, which are inserted through the slot 160. The control switch body 230 is slid into the slot until the protrusion 240 of the retention arm engages one of the position grooves 200-206. The control pin 232 is inserted through the control switch body 230 and into the control passageway 216 of the shaft collar.

The safety razor 100 is preferably supplied to the user with the handle assembly 104 fully assembled and blade assembly 102 attached thereto and/or included in a kit therewith. To attach the blade head assembly 102, the keyslot 132 and key 214 are aligned, and the blade head assembly 102 is slid onto the shaft assembly 146 until the resilient tab 134 engages the annular groove 210. Over-insertion is prevented by engagement of the blade head assembly body 110 with the handle body 142.

Shaving with the safety razor 100 proceeds substantially as described in connection with the razor 10, except that a change in shaving direction requires only approximately 60 degrees rotation of the razor 100, as the angled sections 120 are only offset by approximately 120 degrees. Additionally, the pivoting of the blade head assembly 102 relative to the handle assembly 104 can be selected by the user utilizing the control switch assembly 150.

Referring particularly to FIG. 10, in a first functional position, the protrusion 240 is engaged in the groove 200 and the control pin 232 is in the control section 220. As a result, the control shaft assembly 146 and the blade head assembly 102 are pivotable in either direction from the neutral position, although limited by the outer edges of the control passageway 216.

In a second functional position, the protrusion 240 is engaged in the groove 202 and the control pin 232 is in the control section 222. As a result, the control shaft assembly 146 and the blade head assembly 102 are pivotable only to the right (relative to the orientation of FIG. 10) from the neutral position, with pivoting to the right limited by the outer edges of the control passageway 216.

In a third functional position, the protrusion 240 is engaged in the groove 204 and the control pin 232 is in the control section 224. As a result, the control shaft assembly 146 and the blade head assembly 102 are pivotable only to the left (relative to the orientation of FIG. 10) from the neutral position, with pivoting to the left limited by the outer edges of the control passageway 216.

In a fourth functional position, the protrusion 240 is engaged in the groove 204 and the control pin 232 is in the control section 224. As a result, the control shaft assembly 146 and the blade head assembly 102 are not pivotable.

Further motion of the control switch assembly 150 from the fourth functional position will bring the ejector arm 242 into contact with the blade head assembly, and overcoming the engagement between the resilient tab 134 and the groove 210, result in ejecting the blade head assembly 102. Because the control switch engagement section 196 flares outwardly moving toward the blade head assembly 102, the control switch assembly 150 will automatically be biased back into the fourth position when external pressure is removed from the control switch assembly 150. Engagement between the control passageway 216 and the control pin 242 inhibits pushing the control switch assembly 150 out of the slot 160.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A safety razor assembly, the assembly comprising:

a blade head assembly having a head body elongated along a longitudinal axis;

a first blade set mounted to an exterior of the head body and extending generally parallel to the longitudinal axis;

a head channel disposed within an interior of the head body along the longitudinal axis, wherein the head channel having an open proximate end and a closed distal end;

a handle assembly having a central shaft, wherein a first end of the central shaft is configured to slide into the open proximate end of the head channel and releasably secure the head body to the handle assembly along the longitudinal axis in line with the handle assembly;

the head body is configured to axially pivot about the shaft assembly when the head body is secured to the central shaft; and the handle assembly having a coil spring, a first end of the coil spring secured to a slot disposed in a second end of the central shaft and a second end of the coil spring fixedly secured to another portion of the handle assembly, wherein the coil spring is configured to twist in a first direction and store energy in the coil spring when an external force rotates the central shaft to a resisting position, and to release the energy stored in the coil spring and rotate in an opposing second direction to a neutral position when the external force is removed.

2. The assembly of claim 1, wherein the head channel includes a keyway to cooperate with a key on the shaft-assembly and configured to releasably secure the head body to the handle assembly.

3. The assembly of claim 2, wherein the head body further comprising a resilient tab extending into the head channel and dimensioned to releasably engage a groove of the shaft assembly.

4. The assembly of claim 3, wherein head body includes a second blade set, the second blade set extending generally in parallel with the longitudinal axis, the first and second blade sets arranged facing away from each other.

5. The assembly of claim 4, wherein the head body includes first and second angled sections having a common apex, the first blade set being arranged on the first angled section and the second blade set being arranged on the second angled section.

6. The assembly of claim 5, wherein the angled sections are offset by approximately 120 degrees.

7. The assembly of claim 6, wherein respective razor edges of the first and second blade sets are both oriented away from the common apex.

8. The assembly of claim 7, wherein an applicant strip extends along the common apex between the first and second blade sets.

9. The assembly of claim 8, wherein each blade set includes at least one generally bow-shaped biasing element located under each blade of the first and second blade sets.

* * * * *